US006174385B1

(12) United States Patent
Morinaga et al.

(10) Patent No.: US 6,174,385 B1
(45) Date of Patent: Jan. 16, 2001

(54) FERRITIC HEAT RESISTANT STEELS

(75) Inventors: Masahiko Morinaga, Nagoya; Yoshinori Murata, Toyohashi; Ryokichi Hashizume, Osaka, all of (JP)

(73) Assignee: The Kansai Electric Power Co., Inc., Osaka (JP)

( * ) Notice: Under 35 U.S.C. 154(b), the term of this patent shall be extended for 0 days.

(21) Appl. No.: 09/192,202

(22) Filed: Nov. 16, 1998

Related U.S. Application Data

(63) Continuation of application No. 08/765,667, filed as application No. PCT/JP95/01339 on Jul. 5, 1995, now Pat. No. 5,888,318.

(30) Foreign Application Priority Data

Jul. 6, 1994 (JP) ..... 6-155019

(51) Int. Cl.[7] ..... C22C 38/18

(52) U.S. Cl. ..... 148/325; 420/34; 420/36; 420/37; 420/129

(58) Field of Search ..... 420/129, 34, 36, 420/37; 148/325

(56) References Cited

U.S. PATENT DOCUMENTS 4,824,637 * 4/1989 Yukawa et al. ..... 420/129

FOREIGN PATENT DOCUMENTS 53-61514 * 6/1978 (JP) .
2-197550 * 8/1990 (JP) .
2-290950 * 11/1990 (JP) .
2-310340 * 12/1990 (JP) .
3-053047 * 3/1991 (JP) .
3-274223 * 12/1991 (JP) .
4-371552 * 12/1992 (JP) .
5-40806 * 6/1993 (JP) .
5-212582 * 8/1993 (JP) .
0691416 A1 * 1/1996 (JP) .

OTHER PUBLICATIONS

"Compositions, Structures and Creep Characteristics of Heat Resistant Alloys," 78th Conference of the Japan Metal Society and the Iron and Steel Institute, (undated) pp. 1–8.*
Journal of Metal Institute of Japan, vol. 31, No. 7 (1992), pp. 599–603.*

(List continued on next page.)

* cited by examiner

*Primary Examiner*—Sikyin Ip
(74) *Attorney, Agent, or Firm*—Burns, Doane, Swecker & Mathis, LLP

(57) ABSTRACT

A method of designing a ferritic iron-base alloy having excellent characteristics according not to the conventional trial-and-error technique but to a theoretical method, and a ferritic heat-resistant steel for use as the material of turbines and boilers usable even in an ultrasupercritical pressure power plant. Specifically, the d-electron orbital energy level (Md) and the bond order (Bo) with respect to iron (Fe) of each alloying element of a body-centered cubic iron-base alloy are determined by the Dv-Xα cluster method, and the type and quantity of each element to be added to the alloy are determined in such a manner that the average Bo value and average Md value represented respectively by the following equations:

$$\text{average Bo value} = E\ Xi\cdot(Bo)i \quad (1)$$

$$\text{average Md value} = E\ Xi\cdot(Md)i \quad (2)$$

coincide with particular values conforming to the characteristics required of the alloy; wherein Xi represents atomic fraction of an alloying element i, and (Bo)i and (Md)i represent respectively the Bo value and Md value of the element i. Preferably, the average Bo value and average Md value are, respectively, in the ranges of 1.805 to 1.817 and 0.8520 to 0.8628.

8 Claims, 5 Drawing Sheets

OTHER PUBLICATIONS

Altopia, (Sep. 1981), pp. 23–31.*

"Electronic Approach to the Prediction of Phase Stability in Cr–Mo Ferritic Steels," by Hisakazu Ezaki et al., *Iron and Steel*, vol. 78 (1992) pp. 1377–1382.*

"Development and Applications of 9Cr–2Mo Thick–Walled Pipe For Ultra Super Critical Power Plant", Hisao Haneda et al., "Technology of Pipe and Tube and Their Preparation," Proceedings of the Third International Conference on Steel Rolling, (Sep. 2–6, 1985) pp. 669–676.*

*Journal of Metal Institute of Japan*, vol. 27, No. 3 (1988), pp. 165–172.*

*Light Metals*, vol. 42, No. 11 (1992), pp. 614–621.*

FERRITIC HEAT RESISTANT STEELS

This application is a continuation of application Ser. No. 08/765,667, filed Jan. 6, 1997, the National Phase of PCT/JP95/01339 filed Jul. 5, 1995.

TECHNICAL FIELD

This invention relates to a method of designing ferritic iron-base alloys on the basis of a predicting system without depending upon conventional trial-and-error experimental procedures. This invention also relates to high strength ferritic heat resistant steels which exhibit high temperature strength and other physical and chemical properties more excellent than those of the conventional ferritic heat resistant steels. The steels are particularly suitable for materials of turbines and boilers.

BACKGROUND ART

Although heat resistant steels are used in various areas, materials of turbines and boilers are the typical uses of the ferritic heat resistant steels. Therefore, the heat resistant steels of this invention will be specified in terms of turbine and boiler materials hereinafter.

Most of conventional heat resistant steels hitherto developed for use in boiler and turbine materials contained 9 to 12% chromium as well as one or more of carbon, silicon, manganese, nickel, molybdenum, tungsten, vanadium, niobium, titanium, boron, nitrogen and copper, in amounts of 0.04 to 2.0%, respectively. It should be noted that "percent (%)" means "mass %" herein unless any explanatory note is given.

Compositions of typical heat resistant steels for materials of turbines and boilers are listed in Table 1 and Table 2 (refer to "Compositions, Structures and Creep Characteristics of Heat Resistant Alloys" distributed as a brief at the 78th conference held under co-sponsorship of Japan Metal Society and Kyushu branch of Japan Iron and Steel Institute . . . Reference 1). All these steels have been developed by many experiments wherein various elements of various amounts were alloyed in turn. The action and function of each said alloying element has come to be known by such trial-and-error experiments and can be roughly summarized as follows.

Chromium

Chromium improves corrosion and heat resistance of the steel. Chromium content should be increased as the service temperature of the steel is elevated.

Tungsten, Molybdenum

These elements improve high temperature strength of the steel due to their function for bringing about solid solution hardening and precipitation hardening in the structure of the steel. However, as contents of these elements are increased, the ductile-brittle transition temperature (DBTT) of the resultant steel is elevated. In order to suppress the embrittlement of the steel, the molybdenum equivalent [Mo+(½)W] is necessarily lowered below 1.5%. In accordance with this instruction, the molybdenum equivalent of most of the conventional alloys is around 1.5%.

Vanadium, Niobium

These elements will bring about strengthening of a steel due to formation of carbo-nitrides through precipitation hardening. The solid solubility of vanadium in a steel is 0.2%, whereas that of niobium is 0.03%, when the steel is annealed at a temperature of 1050° C. If the amount of vanadium and that of niobium exceed their respective solid solubility, the excess amount of vanadium and that of niobium will form their carbides and nitrides in the steel matrix during annealing. Results of experimental work obtained up to the present, in particular that of creep rupture tests, show that the optimum vanadium and niobium contents are 0.2% and 0.05%, respectively. The niobium content "0.05%" in the steel exceeds its solid solubility, and the excess niobium forms NbC which is effective to suppress coarsening of austenitic crystal grains during annealing heat treatment.

Copper

As copper is one of the austenite stabilizing elements, it suppresses formation of the δ -ferrite as well as precipitation of iron carbides. Copper in the steel exhibits a weak action of lowering the $Ac_1$ point and improves hardenability of the steel. Copper suppresses forming a softened layer in a heat affected zone (hereinafter designated as HAZ). However, addition of more than 1% copper to a steel decreases its reduction of area upon creep rupture.

Carbon, Nitrogen

These elements are effective to control structure and strength of the steel. Concerning creep properties of the steel, the optimum carbon and nitrogen amounts for creep rupture strength depend on contents of vanadium, niobium or the like carbide and/or nitride forming elements in the steel.

Boron

About 0.005% of boron in a steel improves its hardenability. It is said that boron is further effective to make the steel structure fine and thereby to improve strength and toughness.

Silicon, Phosphorus, Sulphur, Manganese

In order to suppress embrittlement of the steel by making it super-clean, these elements are desired to be as low as possible. However, silicon has an effect of suppressing oxidizing attack of water vapor on the steel. So it is said that some amount of silicon should be kept in the boiler steel.

The action and function of each alloying element are clarified to some extent in accordance with the conventional alloy developing method, as mentioned above. However, a great deal of experimental work will be required before obtaining a novel sort of steel with desirable chemical and physical properties. For example, in a steel containing five alloying elements, if the content of each element is changed in three content levels, $3^5$ combinations could be produced and such huge numbers of alloys have to be melted, cast and formed into various test specimens, followed by a great deal of experimentations.

As shown in Tables 1 and 2, most of the heat resistant steels recently developed contain more than ten alloying elements. Development of new steels like the steels in FIGS. 1 and 2 in accordance with the conventional trial-and-error method requires a great deal of labor, time and cost.

We, the inventors, already developed a method of designing novel metallic materials on the basis of a molecular orbital theory. An outline of the method is disclosed in "Journal of Metal Institute of Japan, Vol.31, No.7(1992), pp 599–603" (Reference 2) and "*Altopia*, September 1991, pp. 23–31" (Reference 3). Meanwhile, we filed a Japanese Patent Application relating to "A Method of Producing Nickel Base Alloys and Austenitic Ferrous Alloys" [refer to Japanese Patent No.1,831,647 (Japanese Patent Publication No.5-40806) corresponding to U.S. Pat. No. 4,824,637].

It is certain that, in view of the above-mentioned references and patent documents, the novel alloy designing method is applicable to produce aluminum base alloys, titanium base alloys, nickel base alloys and the like nonferrous alloys, intermetallic compound alloys and austenitic iron-base alloys. However, it has not been certain that the novel alloy designing system can be applicable to produce ferritic heat resistant steels.

This invention has been accomplished to provide a novel alloy designing system for producing iron base alloys, particularly ferritic heat resistant steels, without the need of troublesome trial-and-error experimentation.

Therefore, an object of this invention is to provide a method of producing with high efficiency ferritic iron base alloys excellent in high temperature strength on the basis of theoretical predicting system.

Another object of this invention is to provide ferritic heat resistant steels which are excellent in various physical and chemical properties such as high temperature strength, as compared with the conventional ferritic heat resistant steel and therefore are well applicable to turbine and boiler materials which are durable even for a severe water vapor environment of 246–351 kgf/cm$^2$ g pressure and 538–649° C. temperature.

DISCLOSURE OF INVENTION

This invention is intended to provide the following methods (1) and (2) of producing ferritic heat resistant steels, and the following ferritic heat resistant steels (3) to (5)

(1) A method of producing ferritic iron base alloys characterized in that both d-electron orbital energy level (Md) of each alloying element contained in a body centered cubic iron base alloy and bond order (Bo) of each said alloying element to iron (Fe) are determined by Dv-X $\alpha$ cluster method, and type and amount of any alloying element to be added to said iron base alloy are determined in such a manner that average Bo value expressed by following formula 1 and average Md value expressed by following formula 2 are kept in a respective desirable range in accordance with the aimed chemical and physical properties of the steel to be produced.

$$\text{average Bo value}=E\ Xi\cdot(Bo)i \quad (1)$$

$$\text{average Md value}=E\ Xi\cdot(Md)i \quad (2)$$

wherein Xi is the atomic fraction of an alloying element i, and (Bo)i and (Md)i are Bo value and Md value for the alloying element i, respectively.

(2) A method of producing strong ferritic heat resistant steels according to (1), wherein the above-mentioned average Bo value is restricted in a range of 1.805 to 1.817, and the above-mentioned average Md value is restricted in a range of 0.8520 to 0.8628.

(3) A ferritic heat resistant steel characterized in that the steel contains, in mass % basis, 9.0–13.5% chromium, 0.02–0.14% carbon, 0.5–4.3% cobalt, 0.5–2.6% tungsten, and that the above-mentioned average Bo value and the above-mentioned average Md value are located in the area surrounded by segment AB, segment BC, segment CD and segment DA, or on one of those segments in FIG. 6.

(4) A ferritic heat resistant steel characterized by consisting of, in mass a basis, 0.07–0.14% carbon, 0.01–0.10% nitrogen, not more than 0.10% silicon, 0.12–0.22% vanadium, 10.0–13.5% chromium, not more than 0.45% manganese, 0.5–4.3% cobalt, 0.02–0.10% niobium, 0.02–0.8% molybdenum, 0.5–2.6% tungsten, 0–0.02% boron, 0–3.0% rhenium and the balance iron and incidental impurities.

(5) A ferritic heat resistant steel characterized by consisting of, in mass % basis, 0.02–0.12% carbon, 0.01–0.10% nitrogen, not more than 0.50% silicon, 0.15–0.25% vanadium, 9.0–13.5% chromium, not more than 0.45% manganese, 0.5–4.3% cobalt, 0.02–0.10% niobium, 0.02–0.8% molybdenum, 0.5–2.6% tungsten, 0–0.02% boron, 0–3.0% rhenium and the balance iron and incidental impurities.

The heat resistant steel (4) is particularly suitable for use as turbine material, whereas the steel (5) is suitable for use as boiler material. Among incidental impurities contaminating the steels (3) to (5), nickel is preferably restricted in a range of not more than 0.40 mass %. Phosphorus and sulfur are preferably restricted in a range not exceeding 0.01 mass %, respectively in the steel (4).

BEST MODE FOR EXECUTING THE INVENTION

The most significant feature of the method of this invention is to first calculate "alloying parameters" for each alloying element in body centered cubic (hereinafter designated as "bcc") crystal structure of iron base alloys using DV-X$\alpha$ cluster method which is one of the molecular orbital calculating methods, and then clarify the action and function of each said alloying element in terms of the alloying parameters, and finally select types of alloying elements and their contents both of which are capable of giving desired properties to the alloys.

By using the above-mentioned alloying parameters, phase stability and high temperature creep properties of the ferritic heat resistant steel can be estimated. That is to say, theoretical estimation of the ferritic heat resistant steel can be made, which leads to further developing of new heat resistant steels.

The above-mentioned heat resistant steels (3) to (5) having the novel chemical compositions are the steels designed according to the method of this invention.

Now, the fundamental theory of the method of this invention will be described in detail.

[I] Induction of Alloying Parameter by Molecular Orbital Method

Figure 3:
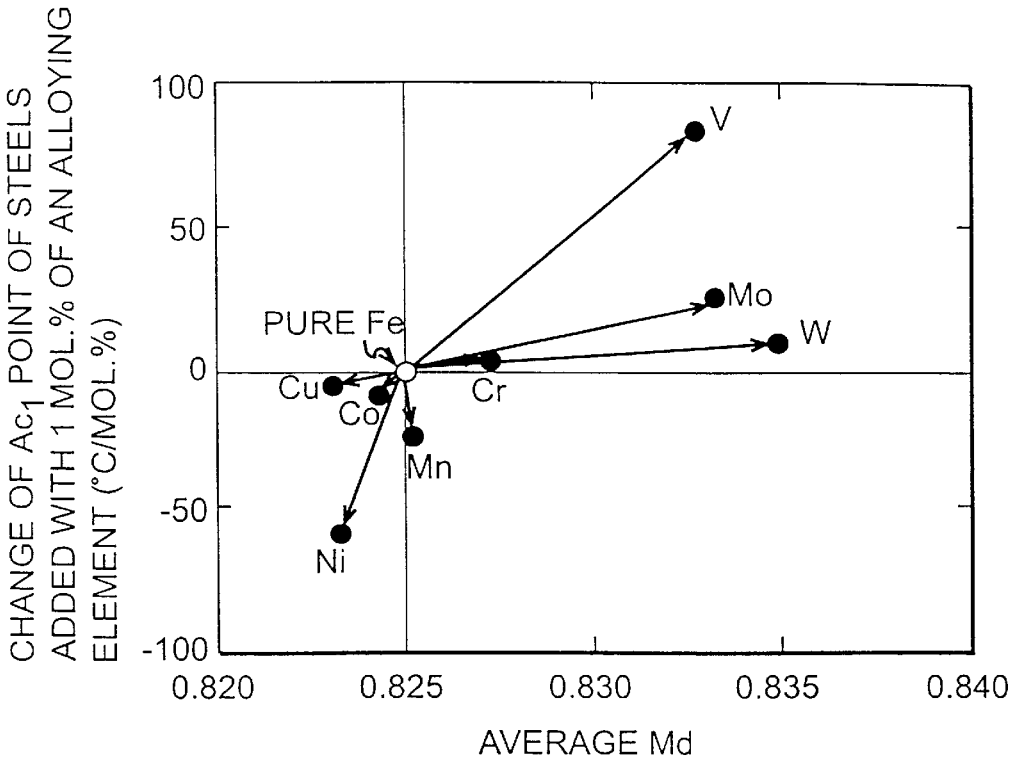
FIG. 3 is a diagram showing the relation between average Md values and variations of the $Ac_1$ point of the alloy wherein 1 mol. % of any one of alloying elements is added to iron.

FIG. 3 shows a cluster model used for a calculation of the electronic structure of a bcc iron alloy. In this model, a center positioned alloying element M is surrounded by 14 iron atoms in the first and the second nearest neighbor positions. Inter-atomic distance in the cluster is determined on the basis of the lattice constant of pure iron, i.e., 0.2866 nm, and an electronic structure of the alloy in the case of replacing the center positioned iron atom with any alloying element M is calculated by the DV-Xα cluster method (Discrete-Variation-Xα cluster method, the details of which are described in "The Fundamentals to Quantum Material Chemistry", published by Kyoritsu Shuppan K. K. . . . Reference 4, and Japanese Patent Publication No.5-40806) which is one of the molecular orbital calculating methods.

Values of two types of alloying parameters for several alloying elements obtained by the calculation are shown in Table 3. One of those alloying parameters is Bond Order (abbreviated as "Bo") which represents the degree of overlapping of electron clouds caused between iron atoms and the M atom. The greater is the Bo value, the stronger is the inter-atomic bond. The other alloying parameter is d-orbit energy level (abbreviated as "Md") of alloying element M, which is correlative with the electronegativity and the atomic radius of the alloying element. Although the unit of Md is electron volt (eV), description of this unit is hereinafter omitted for simplification.

Md values for non-transition metal elements, i.e., carbon, nitrogen and silicon, as shown in Table 3, were determined on the basis of phase diagrams and experimental data. Since these elements do not have d-electrons, they are handled in the above-mentioned manner to discuss on the same basis as the transition elements.

Average content is determined for each alloying element, as shown in the following formulae and average Bo and Md values are calculated on the basis of each said average content of the element.

$$\text{Average Bo value}=E\ Xi(Bo)i \quad (1)$$

$$\text{Average Md value}=E\ Xi(Md)i \quad (2)$$

wherein Xi is molar fraction of an element "i", (Bo)i is Bo value of the element "i" and (Md)i is Md value of the element "i". In reality Bo and Md values cited in Table 3 are used in place of those average values. Both Bo and Md values not cited in Table 3 are regarded as zero.

Figure 1:
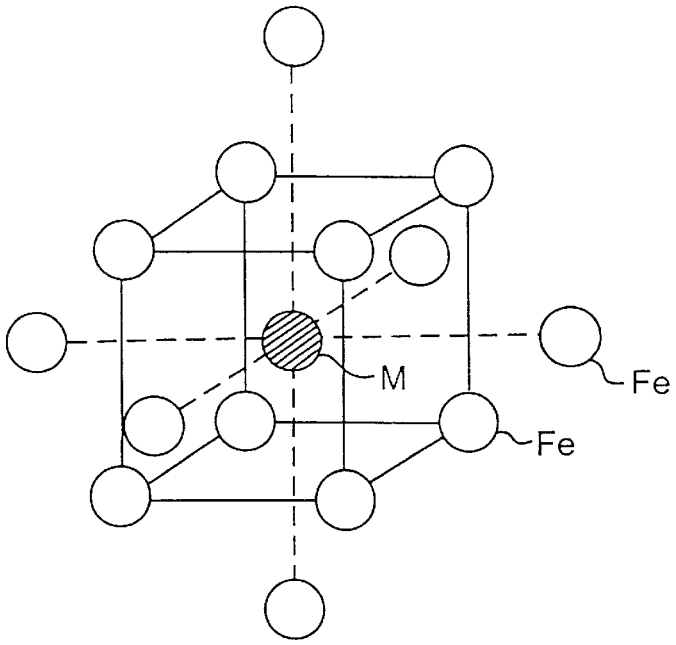
FIG. 1 is a cluster model for a calculation of Md and Bo values of a body centered cubic iron.
Figure 2:
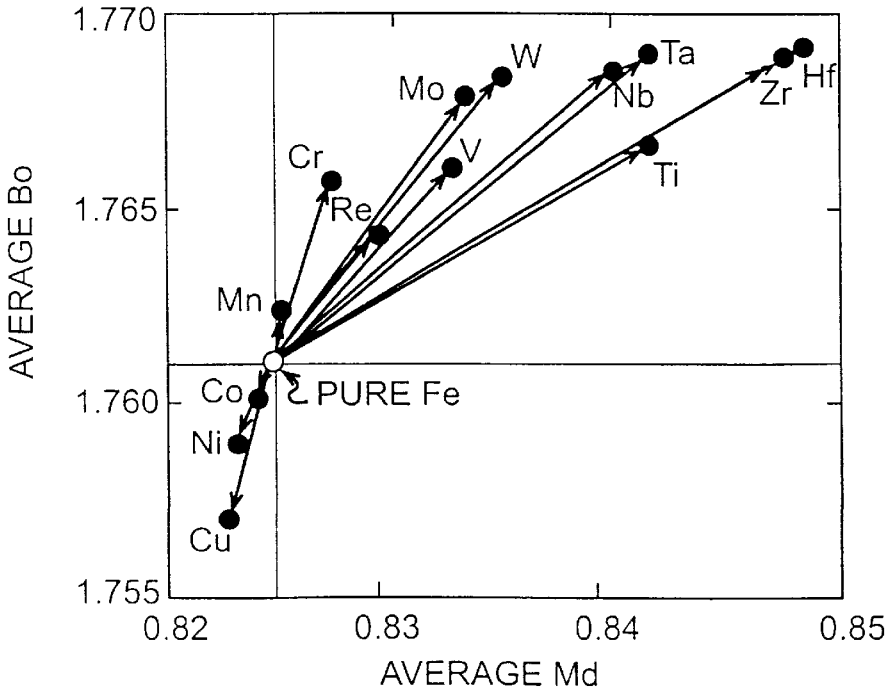
FIG. 2 is a diagram showing locations of average Bo values and average Md values of alloys wherein 1 mol. % of any one of alloying elements is added to iron, and alloying vectors of each alloying element.

[II] Estimation of Feature of Element and Selection of Alloying Elements on the Basis of the Alloying Parameter Alloying parameters of elements (M) are arranged and illustrated on the Average Bo—Average Md diagram in FIG. 2, wherein average Bo and average Md of every "Fe-1 mol % M alloy" are marked with symbol ●. It will be apparent from the diagram that the positions of symbol ● are greatly changed by the types of alloying elements. Every alloying element, whose symbol ● is located in the upper-right zone of symbol ○ of iron, is a ferrite former except manganese. Manganese and other alloying elements which are located in the lower-left zone in FIG. 2 are austenite formers.

It is preferable that the alloying elements of the ferritic heat resistant steel have a higher Bo value and a lower Md value. The high Bo elements strengthen the alloy by increasing the inter-atomic bond. Md is connected with phase stability of the alloy as hereinafter described. If the average Md value of the alloy is increased, the secondary phase (δ phase, etc.) is unfavorably precipitated in the matrix (refer to "Iron and Steel" vol. 78, (1992), p.1337 . . . Reference 5). In view of high averaged-Bo value and low averaged-Md value, chromium is an optimum alloying element which well satisfies those conditions as illustrated in FIG. 2. Chromium exhibits the highest inclination of "alloying vector," i.e., the ratio of "average Bo/average Md". The ratio with respect to each element decreases in the order of Mo, W, Re, V, Nb, Ta, Zr, Hf and Ti.

On the other hand, austenite forming elements except manganese exhibit a negative "average Bo/average Md" ratio, which decreases in the order of Co, Ni and Cu. As shown in Tables 1 and 2, most of the boiler steels do not contain nickel, whereas most of the turbine steels contain it as an essential element. Copper is contained in only the HCM12A steel for boilers. Cobalt is not contained in any of the turbine and boiler steels.

Rhenium, as well as cobalt, has not been used intentionally in spite of the fact that they seem to be effective alloying elements for ferritic heat resistant steels in view of the above-mentioned theoretical presumption. Ferritic heat resistant steels according to this invention contain cobalt, or cobalt and rhenium as essential components as described hereinafter.

Ferritic heat resistant steels are usually tempered to obtain a single phase structure of tempered martensite. In order to increase creep rupture strength at an elevated temperature for long periods of time, a tempering treatment should be carried out at a temperature as high as possible. For this purpose, the $Ac_1$ transformation point which is the upper limit of the tempering temperature must be elevated. The $Ac_1$ transformation point is given by the following empirical formula:

$$Ac_1\ \text{point}\ (^\circ C.)=760.1-23.6\ Mn-58.6\ Ni-8.7\ Co-6.0\ Cu+4.2\ Cr+25.7\ Mo+10.3\ W+84\ V \quad (3)$$

wherein each element represents content (mass %) thereof.

FIG. 3 shows a relationship between the average Md and changes of the $Ac_1$ point ($\Delta Ac_1$), when bcc iron is added with 1 mol. % of alloying elements. As mentioned above, elements having a low average Md and serving to elevate the $Ac_1$ point are most suitable for the alloying element of the heat resistant steel. In this respect, FIG. 3 teaches that vanadium having a comparatively great "$\Delta Ac_1$/average Md" ratio is an effective element. On the contrary, chromium scarcely contributes to elevate $\Delta Ac_1$. In comparison with nickel and cobalt, the latter does not lower so distinctively the $Ac_1$ point. In this connection, cobalt is considered to be more suitable than nickel as an alloying element.

Since manganese lowers the $Ac_1$ point and does not have so great a Bo value, the manganese content is preferably low. As copper lowers the $Ac_1$ point of a steel to a similar degree as cobalt, addition of copper to a steel is actually tried for example in the HCM12A steel as listed in Table 1.

[III ] Evaluation of Phase Stability of Ferritic Heat Resistant Steels

In order to improve creep properties and toughness of the ferritic heat resistant steels, formation of δ -ferrite must be suppressed. According to the method of this invention, formation of the δ -ferrite can-be predicted with fair accuracy.

Figure 4:
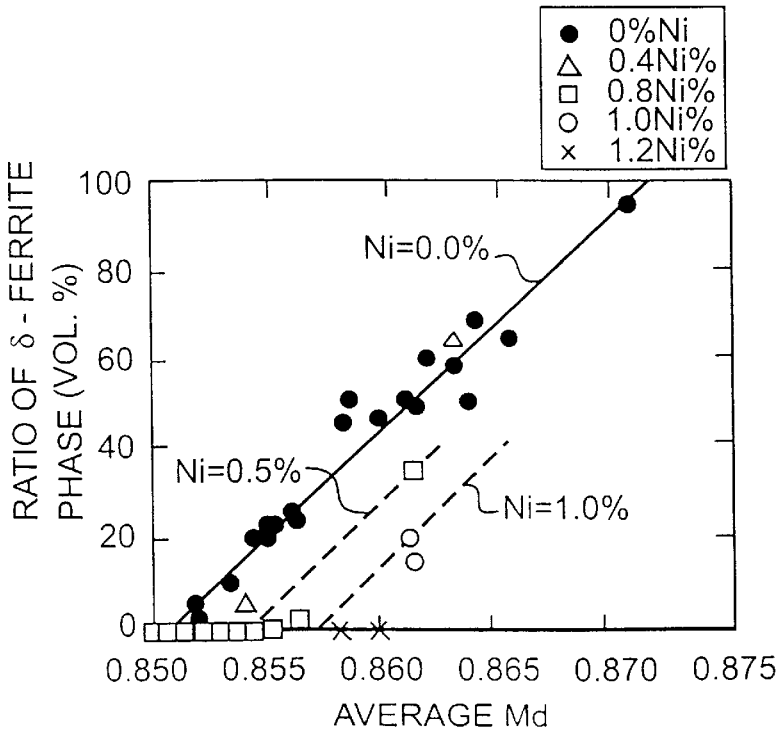
FIG. 4 is a diagram showing the relation between average Md value and $\delta$ -ferrite phase volume.

FIG. 4 illustrates a correlation of amounts of residual ferrite in several steel specimens containing different levels of nickel and normalized at 1050° C. with a parameter of average Md value. The δ-ferrite phase begins to form at the average Md value slightly exceeding 0.852 and increases in proportion to the increasing average Md value. The average Md value tends to become slightly higher above the δ -ferrite forming boundary due to the addition of nickel, which is one of the austenite stabilizing elements, to the steel.

An amount of the δ -ferrite phase can be predicted from a composition of a steel, and whereby formation of the δ -ferrite can be suppressed. Thus, the prediction of the δ -ferrite amount on the basis of the average Md value is very useful to design novel ferritic heat resistant steels. Additionally, formation of Laves phase ($Fe_2W$, $Fe_2Mo$, etc.) can also be predicted, if nickel, which promotes the formation of the Laves phase, is not contained in the steel.

Figure 5:
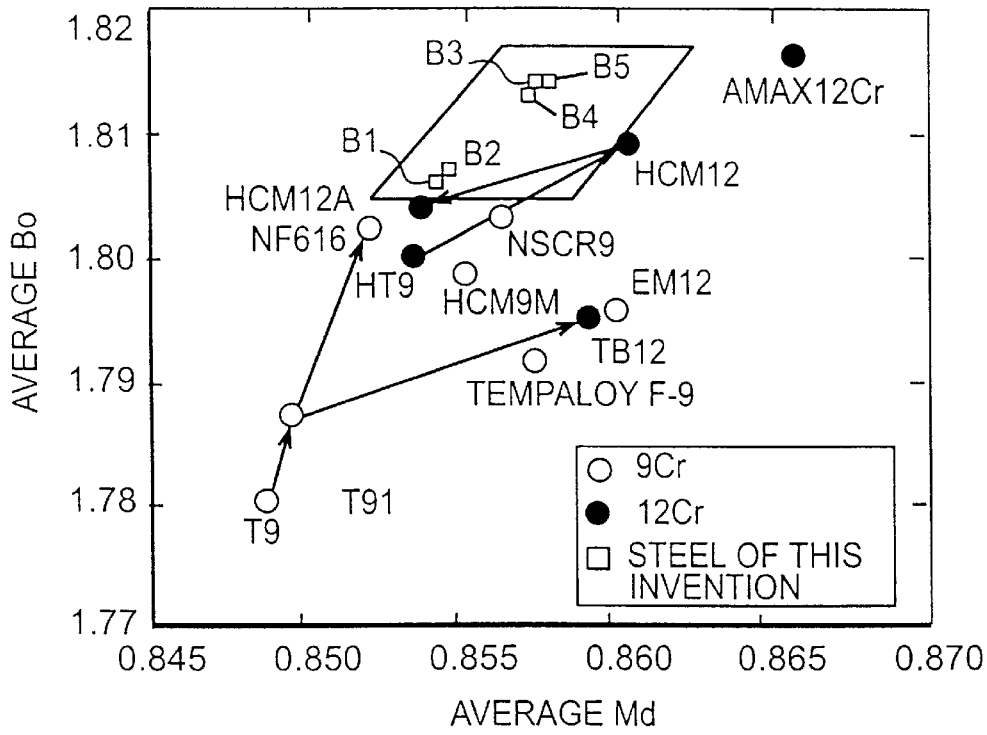
FIG. 5 is a diagram showing the relation between average Md value and average Bo value (hereinafter designated as "Average Md—Average Bo diagram"), wherein the process of development of 9–12% chromium boiler steels is shown.

[VI] Evaluation of Conventional Ferritic Heat Resistant Steels (i) Boiler Materials Average Bo and average Md values are calculated from compositions of 9–12% chromium boiler steels listed in Table 1, and plotted on the Average Bo—Average Md diagram in FIG. 5.

The average Bo value of 2·1/4 Cr-1% Mo steel (JIS STBA24), which is often compared with 9–12% chromium boiler steels, is 1.7568 and the average Md value is 0.8310. These values are quite small as compared with that of materials listed in FIG. 5, and accordingly cannot be illustrated therein by the same scale.

As described in the above-mentioned reference 1, 9% Cr steel was developed in the order of T9→T91→NF616. T91 (modified 9 Cr-1 Mo) is a steel which was developed by adding optimum amounts of vanadium and niobium, which are carbide or carbo-nitride forming elements, to T9 (9 Cr-1 Mo). NF616 is a steel which was developed by decreasing the amount of molybdenum and adding tungsten in place of molybdenum, which exhibits the highest creep rupture strength at present among other 9% Cr steels hitherto produced.

Development of 9% Cr steel will be understood in view of increase of both Bo and Md values as shown by arrow marks on the Average Bo—Average Md diagram in FIG. 5. The average Md value of NF616 is 0.8519, which corresponds to the average Md value at a boundary of δ -ferrite phase formation in the case that nickel is not contained. Thus, NF616 is said to be an alloy which is strengthened by adding thereto certain alloying elements in as high as possible amounts as not to cause δ -ferrite phase formation. It is considered that steel superior to NF616 will not be attainable in the series of steels which do not contain any austenite stabilizing elements, such as nickel and cobalt.

12% Cr steel was developed in the order of HT9→HCM12→HCM12A. HCM12A is a steel which was developed by decreasing the amount of carbon in HT9 and adding thereto tungsten and niobium. Amounts of molybdenum and tungsten in HCM12A are controlled so that the molybdenum equivalent [ Mo+(½)W ] may descend below 1.5%. As mentioned above, formation of the δ -ferrite phase is suppressed by adding 1% copper to the steel.

Development of 12% Cr steels have followed a zigzag line as illustrated on the Average Bo—Average Md diagram in FIG. 5. The average Md value of HCM12A is 0.8536, which approximately corresponds to the average Md value at a boundary of δ -ferrite phase formation, but is somewhat higher than the boundary. Since HCM12A contains 1% copper which is an austenite former like nickel and cobalt, the boundary average Md value is slightly elevated. The average Md value of the steel containing 1% copper is considered to be 0.853 to 0.854. HCM12A is therefore said to be a steel which aims at a critical composition as not to cause δ -ferrite phase formation. When subjecting the steel to a heat treatment slightly different from the standard, formation of the δ -ferrite phase will be duly expected.

More than 30 vol. % of δ -ferrite is formed in HCM12 steel, since it has such a high average Md value as 0.8606 and does not contain any austenite forming elements. As far as TB12 steel is concerned, the δ -ferrite phase would be formed therein in view of its high average Md value (0.8594). It is well known that the δ -ferrite phase is similarly formed in EM12, Tempaloy F-9, HCM9M and the like 9% Cr steels having high average Md values.

It will be summarized that NF616, HCM12A and the similar recently developed materials exhibit a structure of single phase martensite without δ -ferrite and have a great bond order value. B1–B5 steels marked by □ symbol in FIG. 5 are exemplified ferritic heat resistant steels of this invention mentioned later (the heat resistant steels of the above-mentioned (3)), and the average Md values and-average Bo values of these steels are in a area surrounded by a parallelogram.

Figure 6:
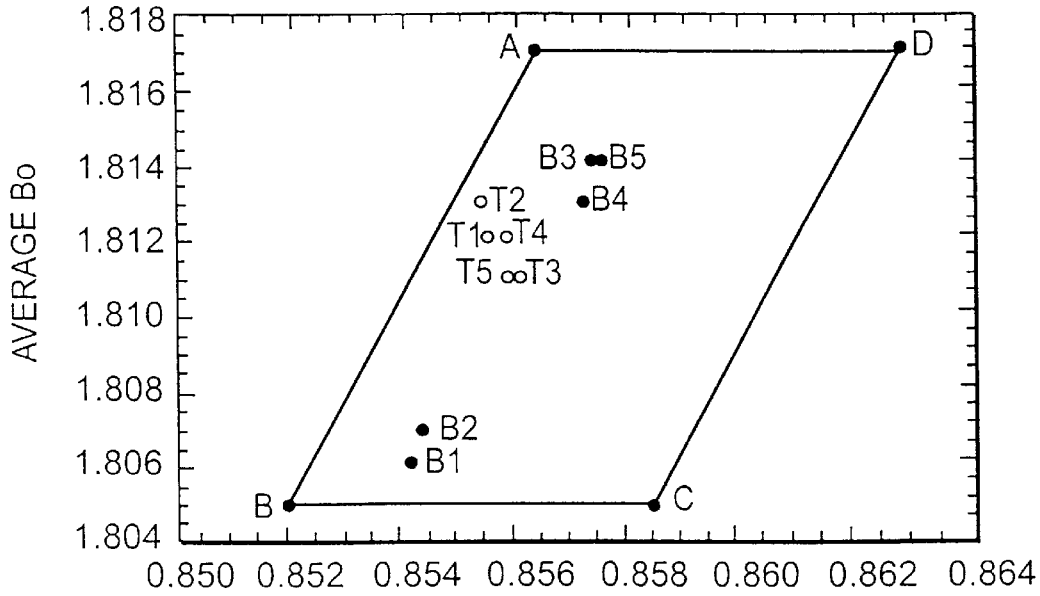
FIG. 6 is a diagram showing the relation between average Md value and average Bo value specific to the heat resistant steels according to this invention.

FIG. 6 is an enlarged view of the parallelogram area in FIG. 5, wherein segment AB is expressed as Average Bo=2.7907×(Average Md)−0.5727, segment DC is expressed as Average Bo=2.7907×(Average Md)−0.5908 and coordinates of points A, B, C and D are expressed as follows:

point A . . . average Md value=0.8563, average Bo value=1.817 point B . . . average Md value=0.8520, average Bo value=1.805 point C . . . average Md value=0.8585, average Bo value=1.805 point D . . . average Md value=0.8628, average Bo value=1.817

Figure 7:
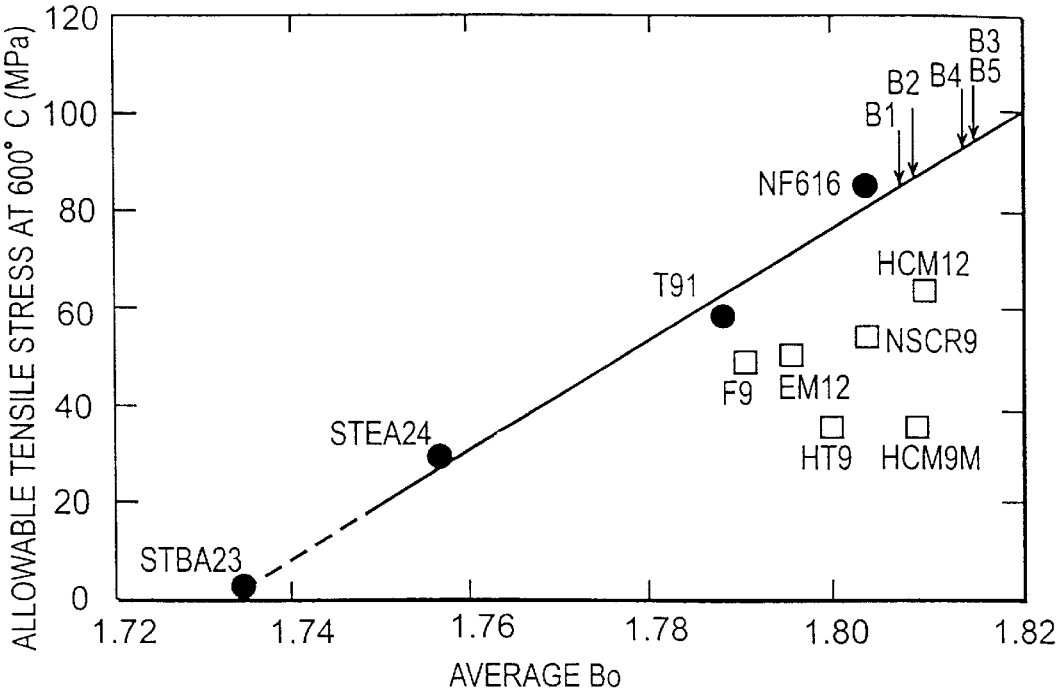
FIG. 7 is a diagram showing the relation between allowable stress and average Bo value for the 9–12% chromium boiler steels.

FIG. 7 shows a relationship between allowable stress at 600° C. (ordinate) and average Bo value (abscissa), wherein the δ -ferrite phase is formed in alloys marked by □ symbol and not in alloys marked by ● symbol. Allowable stress of alloys in which the δ -ferrite phase is not formed is known to linearly increase along a straight line in proportion to the average Bo value. On the other hand, allowable stress of alloys in which δ -ferrite is formed is generally low and lies in a zone below said line. Although the δ -ferrite phase in a steel may be effective to increase its weldability, formation of the δ -ferrite phase should be suppressed in the case that the allowable stress is desired to increase.

(ii) Turbine Materials ii-1 Rotor Materials

Development of 9–12% chromium turbine steels (refer to Table 2) is also described in Reference 1. The rotor materials have been developed in the order of "H46 for small sized article"→GE→TMK1→TMK2. GE for large size articles was developed from H46 by modifying it in respect of lowering niobium content below 0.1% and chromium content below 10% in order to inhibit a formation of abnormal segregation (segregation of δ -ferrite phase, MnS and coarse NbC) in a large scale ingot upon solidification. TMK1 was developed from GE by lowering its carbon content and increasing its molybdenum content. TMK2 was further developed from TMK1 by lowering its molybdenum content and increasing its tungsten content in order to increase its creep rupture strength.

Figure 8:
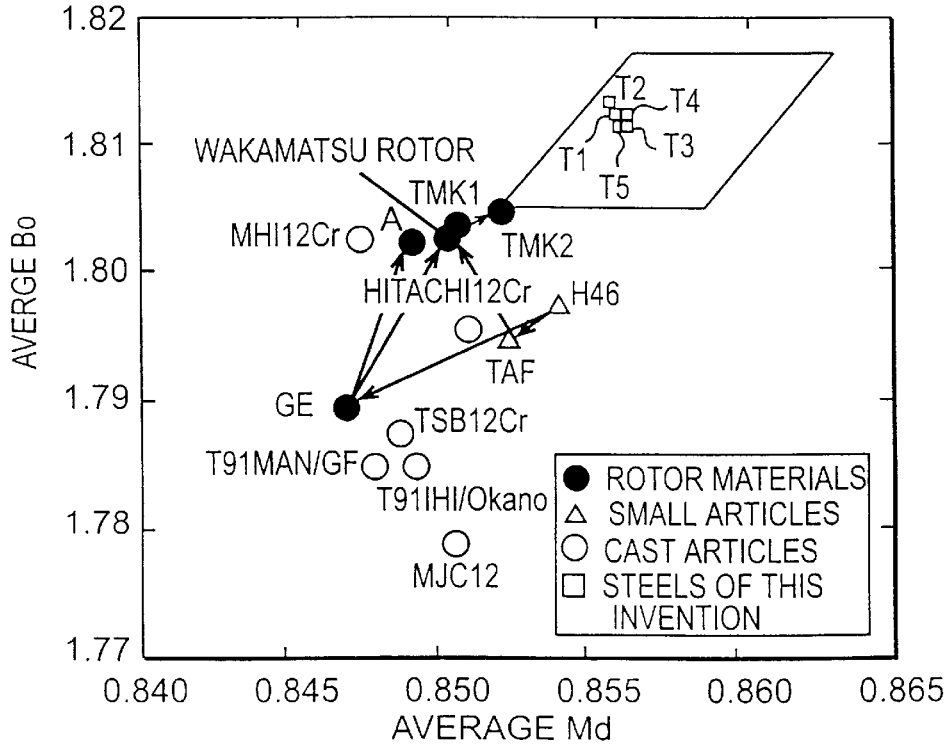
FIG. 8 is the Average Md—Average Bo diagram, wherein the process of development of 9–12% chromium turbine steels is shown.

Development of 12% chromium steel is illustrated on the Average Bo—Average Md diagram in FIG. 8. The locations of the exemplified steels (T1–T5) of this invention are shown by □ symbols in FIG. 8, and the average Md values and the average Bo values of the ferritic heat resistant steels of this invention (heat resistant steels of the above-mentioned (3)) are in a zone surrounded by the parallelogram.

H46 was changed into GE by greatly lowering the average Md value as well as the average Bo value. It can be understood that the segregation has been avoided thoroughly in the production of large scale rotors. However, the development of the rotor materials in the order of GE→TMK1→TMK2 is based on increase of both the average Md value and the average Bo value. This is similar to the change of the boiler materials in the order of T9→T91→NF616. It could be said that the average Md value of each of the rotor materials, GE, TMK1 and TMK2, eventually came near to that of H46, as a result of aiming at improvements of the properties.

Thus, TMK1 and TMK2 were developed, each having the average Bo value higher than that of H46. The average Bo value and average Md value of TMK2 were 1.8048 and 0.8520, respectively, and these values have turned out to be very near the average Bo value of 1.8026 and the average Md value of 0.8519 of NF616, respectively. That is to say, the average Bo values of both boiler and turbine materials are brought together in almost the same zone, as well as the average Md values of both materials. Since TMK1 and TMK2 contain 0.5–0.6% nickel, the average Md values on the δ -ferrite forming boundary is about 0.855 (refer to FIG. 4).

An alloy developed for producing turbine rotor members, which will be exposed to attack of water vapor at a super high temperature such as 593° C., is now subjected to a demonstration test for a super high temperature steam turbine, held at Wakamatsu Power Plant, and the creep rupture strength of the alloy test specimen kept at 593° C. for 100,000 hours may be 12.4 kgf/mm$^2$ (122 MPa), which is near that of TMK1. Actually, the location of the average Bo value—average Md value of this alloy (designated as "Wakamatsu Rotor") on the Average Bo—Average Md value diagram (FIG. 8) is very near to that of TMK1. The alloy (Wakamatsu Rotor) was developed from TAF by selecting optimum amounts of carbon and nitrogen. Another 12% Cr series heat resistant steel durable for a super-high temperature of 593° C. was recently developed from GE. The creep rupture strength of the alloy specimen kept at 593° C. for 100,000 hours is 15.3 kgf/mm$^2$ (150 MPa) which is slightly higher than that of "Wakamatsu Rotor". However, location (shown by "A") of this heat resistant steel on the Average Bo—Average Md diagram is on the low Md side as compared with that of TMK2.

ii-2 Cast Steels

Cast steels are suitable for producing a turbine chamber, a blade ring and similar turbine members. However, the conventional 2·1/4Cr-1 Mo cast steel is poor in high temperature strength and accordingly can not be used in a steam atmosphere higher than 593° C. Table 4 shows compositions of several 9–12% Cr cast steels developed by different steel makers. Locations of these heat resistant steels on the Average Bo—Average Md diagram are on the low average Bo and low average Md area as compared with the rotor materials, as apparent from FIG. 8. The reason is that the composition of the steel is controlled in a manner to avoid segregation and formation of the δ -ferrite phase in the cast steel. Among these cast steels, TSB12 Cr is very similar to MJC12 and T91 cast steel and already utilized in the Kawagoe No. 1 and No. 2 plants. Although MHI12 Cr was already used in the above-mentioned demonstration test for a super high temperature turbine, held at Wakamatsu, the average Md value is low and seems to be designed for avoiding the segregation. On the other hand, HITACHI 12 Cr exhibits higher average Md and higher average Bo values than other 12 Cr steels.

As particularly described above, specific properties of each alloy are fairly clarified in view of the Average Bo—Average Md diagram. It will be understood to one skilled in the art that the development of the conventional materials can be outlined on this diagram, and besides, novel ferritic heat resistant steels provided with more excellent properties than ever can be predicted and designed using this diagram.

[V] Optimum Range on the Average Bo—Average Md Diagram

Areas surrounded by the parallelograms as shown in FIGS. 5 and 8 and the enlarged area in FIG. 6 are the optimum range for the heat resistant steels. The segment BC shows an average Bo level of 1.805, and if the average Bo decreases below the segment level, the creep properties are worsened (refer to FIG. 7). The segment AD is the average Bo level of 1.817, and it will be actually impossible to elevate the average Bo value above the segment level unless the phase stability is decreased.

Point D on FIG. 6 is the point at which the average Md value is 0.8628, which is the safe upper limit not to form δ -ferrite in the actual production of the material. It is not preferable to lower the Bo and Md values below the point B (average Bo value: 1.805, average Md value: 0.8520) in order to maintain the high temperature properties of the alloy.

It is therefore recommendable to design a composition of a ferritic heat resistant steel so that the average Bo value is in the range of 1.805 to 1.817 and the average Md value is in the range of 0.8520 to 0.8628, in the production of steel which is excellent in high temperature creep properties.

The direction of the segment AB in FIG. 6 and that of the segment CD are similar to the direction of the alloying vector of chromium, vanadium, tungsten, niobium, tantalum, rhenium, manganese and cobalt, as shown in FIG. 2, and it will be seen that if the average Bo value is elevated, the average Md value is also elevated along the direction of the alloying vector. This means that the heat resistant steel (steels of this invention mentioned above in item (3)) surrounded by segments AB, BC, CD and DA may be the most desirable ferritic heat resistant steels. The range of chromium content and that of carbon content of this steel are able to ensure and keep the essential physical and chemical properties of the steel. 0.5% of cobalt is a minimum amount to avoid formation of the δ -ferrite phase. On the other hand, if the cobalt content exceeds 4.3%, no further distinctive improvement of the creep properties is expected. Cobalt contents should be in the range of 0.5 to 4.3%, since cobalt lowers the $Ac_1$ transformation point. Tungsten, exhibiting the high Bo value, is an essential element for improving high temperature creep properties, and at least 0.5% tungsten is necessary for this purpose. However, addition of excess amounts of tungsten to the steel is detrimental to the oxidation resistance and creep properties of the resultant steel due to the fact that Laves phase tends to be formed and the steel is thereby embrittled. The upper limit of the tungsten content is determined to be 2.6%. Alloying elements other than indispensable elements should be selected so that the steel can be in the optimum area (the area surrounded by the parallelogram) in FIG. 6. Although nickel is an incidental impurity and preferably as low as possible, contamination of the steel with nickel cannot be avoided since nickel bearing scraps are used in the production of the steel. Contents of up to 0.40% nickel is allowable.

[VI] Guideline for Embodiment of This Invention

The chemical composition of the ferritic heat resistant steel will be designed according to the following guidelines of this invention on the basis of the theory and empirical rules hereinbefore described.

1) Suppress formation of δ -ferrite which is detrimental to high temperature creep properties, the δ -ferrite being suppressed to improve the toughness and creep properties.

2) The $Ac_1$ transformation point shall be elevated as high as possible to improve the creep properties.

3) A proper range of average Md values shall be selected in view of the above-mentioned items 1) and 2). As shown in FIG. 4, the average Md value is required not to exceed 0.8540 when the nickel content is not more than 0.40%. However, the average Md value can be increased up to 0.8628 by increasing the cobalt content as high as around 4%.

4) There is a relationship between the creep properties and the Bond order (average Bo) as shown in FIG. 7. The higher is the Bo value, the higher is the melting point of the material, resulting in an improvement of the creep properties. Therefore, the chemical composition of the steel shall be selected in such a range that the δ -ferrite phase is not formed, i.e., the average Md value does not exceed 0.8628, and the Bo value becomes the highest possible value.

5) In view of preceding items 1) to 4), the essential guideline is to select such a chemical composition of the alloy that the average Bo value is restricted in a range of 1.805 to 1.817 and the average Md value is restricted in a range of 0.8520 to 0.8628.

In addition to that, guidelines for designing compositions of heat resistant steels for boiler and turbine are as follows.

6) Cobalt, one of the austenite stabilizing elements, is indispensably added to the steel, and, if more improvement of high temperature strength and phase stability is required, rhenium could be further added.

7) Contents of tungsten, molybdenum, vanadium, niobium, rhenium and cobalt shall be optimized on the basis of the average Bo value and average Md value.

Steels manufactured according to those guidelines are the heat resistant steels No.1 and No.2, respectively, in Table 5. The No.1 steel exhibits far more excellent high temperature strength than the conventional materials, and is suitable for use in turbine members. This type of steel is hereinafter designated as T-series steel. On the other hand, the No. 2 steel exhibits high temperature creep strength and excellent weldability, and is suitable for use in boiler members. The latter type of steel is hereinafter designated as B-series steel.

[VII] High Strength Ferritic Heat Resistant Steels of This Invention

Table 5 shows compositions of ferritic heat resistant steels (above-mentioned No.1 and No.2 steels) of this invention. These steels are designed to have a novel composition and more excellent chemical and physical properties than that of the above-mentioned TMK2 and NF616 which have the highest quality and performance for use in turbine and boiler members, respectively, at present.

While the TMK2 turbine steel contains low amounts of nickel, the steel of this invention contains cobalt instead of nickel. If the cobalt content is undesirably low, the δ -ferrite phase tends to be formed in the steel. The cobalt content is therefore restricted in a range of 0.5 to 4.3%, as mentioned above.

Rhenium is an element which has a great "average Bo/average Md" ratio as shown in FIG. 2 and improves the strength of the steel without diminishing the phase stability. Although only 0.01% rhenium content is effective to strengthen the steel, more than 0.1% rhenium content is preferable to ensure that effect. However, more than 3% rhenium content is detrimental to the phase stability of the steel, and besides it is not economical to make the steel because rhenium is an expensive element.

The chromium content is adjusted so as to increase both the average Md and the average Bo values of the steel as high as possible, to an extent not to form the δ -ferrite phase.

Now, a composition of the No. 1 steel (mainly used in turbine members) and that of the No.2 steel (mainly used in boiler members) will be described in more detail.

(i) No.1 Steel (T-series Steel)

This steel is typically used in manufacturing turbine members (rotors, blades and some other cast parts. The composition of the steel is preferably adjusted to exhibit both low average Bo and Md values when the steel is cast) and also in automotive and aeroplane engine parts.

1) This steel is designed to contain therein 0.5~4.3% cobalt. The ability of cobalt to stabilize the austenite phase is about half that of nickel. The average Md value at the δ -ferrite phase appearing boundary is therefore anticipated as 0.860 when the cobalt content is 3.0%. These average Md values correspond to the value at the δ -ferrite phase appearing boundary when the nickel content is 1.5% as shown in FIG. 4.

The ability of cobalt to lower the $Ac_1$ point is far less than that of nickel, as apparent from the foregoing formula 3. If cobalt is added to the steel instead of nickel, the $Ac_1$ point can be kept at a higher level which brings about such an advantage that the steel can be tempered at a high temperature.

Thus, nickel which tends to reduce creep properties of a steel is, in principle, replaced with cobalt in the steels of this invention. Since such steels are produced using partly nickel bearing steel scraps for economical reasons, some contamination of the steels cannot be avoided in spite of the fact that the lowest nickel content is preferable. The allowable upper limit of the nickel content of the steels of this invention is therefore restricted to 0.40%, in view of both practical necessities and conditions for δ -ferrite phase formation. The upper limit of the nickel content is preferably 0.25%.

2) In order to adjust the average Md value, the content of nitrogen, which has a negative Md value, is restricted in a range of 0.01 to 0.10%.

3) The allowable upper limit of the manganese content is restricted to 0.45%. A low manganese content together with a low silicon content has an effect of suppressing embrittlement of the steel derived from segregation of impurity elements at grain boundaries and embrittlement derived from precipitation of carbides, resulting in a quite low embrittlement sensitivity. The lower limit of the manganese content is therefore substantially zero.

4) Rhenium is a preferable alloying element for the ferritic heat resistant steel, as shown in FIG. 2. However, since rhenium is a very expensive element, it can be used when its addition is absolutely necessary. In order to ensure the function of rhenium for improving the toughness of the steel against fracture, at least 0.01%, preferably at least 0.1% rhenium should be added thereto. The upper limit of the amount of rhenium is determined to be 3.0% for the above-mentioned economical reasons.

Suitable molybdenum and tungsten contents in the steel are influenced by the rhenium content for technical reasons hereinafter described. The lower limit of the molybdenum content is determined to be 0.02%. The tungsten content preferably ranges from 1.0 to 2.0%. As already described in item [V], excess amounts of tungsten may be detrimental to various properties of the steel. Accordingly, a part of the tungsten is preferably replaced with rhenium which is innocuous to the steel.

5) Boron is often added to ferritic heat resistant steels in order to improve the hardenability and refine the steel structure as described hereinbefore. Boron could be added to the steel of this invention when further increase in high temperature strength and toughness is required. In order to increase the high temperature creep strength, addition of more than 0.001% boron is preferable. However, since more than 0.02% boron is injurious to the workability, the upper limit of boron content should be 0.02%.

6) The chromium content is so determined that the average Bo value and average Md value of the steel are increased to the highest possible level.

7) Silicon is used as a deoxidizer for the steel. Since silicon reduces the toughness of the steel, the residual silicon amount in the steel is preferably as low as possible, and may be substantially zero. The upper limit of the silicon content is determined to be 0.10%. Although aluminum can also be used as a deoxidizer for the steel, it forms A1N and reduces the function of nitrogen. The content of aluminum in the form of acid soluble aluminum may preferably be less than 0.02%. Both phosphorus and sulfur, being incidental impurities, are restricted below 0.01%, respectively, and should be as low as possible to keep clean the steel structure.

(ii) No.2 Steel (B-series Steel)

This steel is principally used in boiler members exposed to an environment of high temperature and high pressure water vapor and also in heat exchanger tube members in chemical or other industries. The guidelines for designing these steel compositions will be specified below.

1) In order to stabilize the austenite phase, 0.5–4.3% cobalt is contained in the steel. The average Md value at the δ -ferrite phase forming boundary is predicted to be 0.856 at 1.5% cobalt content, 0.858 at 2.5% cobalt content and 0.860 at 3.0% cobalt content (the same as that in the No.1 steel). These average Md values correspond to the average Md values at the δ -ferrite phase forming boundary at 0.75% nickel, 1.25% nickel and 1.5% nickel, respectively, as in FIG. 4. Nickel is not positively added to the B-series steel. The upper limit of the nickel content which is allowable to the steel is 0.40%, and preferably 0.25%, the same as in the T-series steel.

2) Rhenium is added to the B series steel if it is necessary, the same as in the No.1 steel. If rhenium needs to be added to the steel, its content should be more than 0.01%, preferably more than 0.1%. The upper limit of the rhenium content is 3.0%. Suitable molybdenum and tungsten contents are influenced by the rhenium content. That is to say, the composition of the No.2 steel, when including rhenium, is adjusted by controlling the molybdenum and tungsten contents, the same as in the No.1 steel. Alloying vectors of rhenium, molybdenum and tungsten have substantially the same direction on the Average Bo—Average Md diagram in FIG. 2, and the influence caused by addition of rhenium can be reduced by lowering the molybdenum and/or tungsten contents. The magnitude of the alloying vector of rhenium is smaller than that of molybdenum and tungsten. The average Bo value and average Md value can therefore be maintained at their original values by slightly reducing the amounts of molybdenum and/or tungsten and substantially increasing the amount of rhenium instead. The favorable tungsten content is the same as that in the steel No.1.

3) The chromium content is determined to be such values that the average Bo value and the average Md value may be as high as possible. As the chromium content increases, $Ac_1$ point of the steel is elevated, resulting in improvement on creep properties.

4) Silicon is used as a deoxidizer also for the B-series heat resistant steel. Oxidation of boiler steel by an attack of high temperature water vapor is a serious problem to be solved. Silicon in the steel is effective to suppress the oxidation of the steel. In view of this oxidation suppressing effect, as well as an effect of decreasing toughness and high temperature creep strength, the maximum silicon content in the steel No.2 is restricted to 0.50%.

5) Handling of manganese, aluminum, nitrogen and boron and other incidental impurities is similar to that in the steel No.1. In order to improve weldability of the steel No.2, the carbon content is restricted to a level lower than that of the steel No.1.

EXAMPLE

1. Preparation of Test Specimens (1) T-series Steel Specimens

Six steels having different compositions as shown in FIG. 14 were melted in a high frequency vacuum induction furnace and cast into six ingots each having a weight of 50 kg. Each ingot was heated to a temperature of 1170° C., hot forged into a billet having a 130 mm thickness and a 35 mm width. The obtained billet was normalized by keeping it at 1100° C. for 5 hours and then air cooled, followed by an annealing treatment wherein the billet was kept at 720° C. for 20 hours and then air cooled.

After that, the following heat treatment steps simulate the heat cycle suffered by the center zone of an actual turbine rotor.

(1) keeping at 1070° C. for 5 hours and oil quenching (hardening)

(2) keeping at 570° C. for 20 hours and air cooling (first tempering)

(3) keeping at T° C. for 20 hours and air cooling (secondary tempering)

Specimen "TO" is the aforesaid conventional heat resistant turbine rotor steel TMK2 which is used as a reference specimen for the various following tests. These steels are principally used in turbine members and referred to as T-series steels.

As shown in Table 6, the T-series steels of this invention contain 3% cobalt. Among them, T1 and T2 steels contain about 0.9% rhenium, and T5 steel contains about 1.7% rhenium. The average Md value and average Bo value of the steels are shown in Table 7. The locations of these steels on the Average Bo—Average Md diagram are shown in FIG. 8 by □ symbol. All these specimens T1–T5 are in a higher average Bo and Md zone in comparison with the TMK2 specimen.

The $Ac_1$ points and $AC_3$ points of TMK2 and T1–T5 specimens are listed in Table 7 as well as the average Md and Bo values. Since the $Ac_1$ points of T1–T5 steels of this invention are higher than that of TMK2 steel by 14 to 32° C. it can be predicted that these steels have excellent high temperature properties.

(2) B-series Steel Specimens

Six steels having different compositions as shown in Table 6 were melted in a high frequency vacuum induction furnace and cast into six ingots each having a weight of 50 kg. Each ingot was heated to a temperature of 1150° C., hot forged into a heavy plate having a 50 mm thickness and a 110 mm width. The obtained plate was cut into about 300 mm length pieces which were then heated at 1150° C., and hot rolled to prepare a sheet having 15 mm thickness and 120 mm width. The sheet was further kept at 1050° C. for 1 hour and then air cooled to obtain a test specimen having a normalized structure.

Specimen "BO" in Table 6 is the above-mentioned conventional boiler steel NF616 which is utilized as a reference specimen for the following tests. Steels of B1–B5 are No.2 heat resistant steels designed according to this invention. These steels are principally used in boiler members and referred to as B-series steels.

The B-series steels take three levels of cobalt contents, i.e., about 1.5% (B1 and B2 steels), about 2.5% (B3 and B4 steels) and about 3% (B5 steel). The B2, B4 and B5 steels contain rhenium. The average Md and Bo values of these steels are shown in Table 7, as well as the $Ac_1$ point and $AC_3$ point. The locations of these steels of this invention on the Average Bo—Average Md diagram are shown in FIG. 5 by □ symbol. As is shown in FIG. 5, since all these specimens B1 to B5 are in a higher average Bo and Md zone as compared with the NF616 specimen, it can be predicted that these steels have more excellent high temperature properties.

Locations of the average Bo value of the No.2 steels of this invention are shown by an arrow mark in "allowable stress—average Bo value" diagram of FIG. 7. In view of the above-mentioned composition designing guidelines, it appears that the δ -ferrite phase is not formed in the B1–B5 specimens. The allowable stress value of the steel can therefore be predicted by a straight line in the FIG. 7. B3, B4 and B5 steel specimens are presumed to have about 98 MPa (10 $kgf/mm^2$) allowable stress at 600° C.

2. Testing Procedure

Various tests were carried out using the above-mentioned specimens in accordance with the following procedure.

(1) Tensile test at room temperature (common to T-series steels and B-series steels):

The tensile tests were carried out using JIS No.4 test specimens for T-series steels and using JIS No.14 test specimens for B-series steels.

(2) Visual inspection of microstructure (common to T-series steels and B-series steels):

Each specimen was etched by Vilella solution (chloric acid—picric acid—alcohol) and inspected with a microscope under 100 and 500 magnification.

(3) Tensile test at an elevated temperature (common to T-series steels and B-series steels):

High temperature tensile tests were carried out in accordance with directions of JIS G 0567 using "I" shaped test specimens.

(4) Charpy impact test (common to T-series steels and B-series steels):

Charpy impact tests were carried out using JIS No.4 impact test specimens.

(5) Creep rupture test (common to T-series steels and B-series steels):

Creep rupture tests were carried out in accordance with directions of JIS Z 2272 using a round bar test specimen having 6 mm diameter and 30 mm gauge length.

(6) Measuring maximum hardness of HAZ (only for B-series steels):

The maximum hardness of HAZ was measured in accordance with a direction of JIS Z 3101 using No.2 test specimens wherein a welding bead was formed on the center zone of the test specimen. The welding conditions for forming the bead were as follows.

| | |
|---|---|
| Welding rods | NF 616 rod having 4.0 mm diameter (prepared by Nittetsu Yosetsu K. K.) |
| Preheating temperature | 150° C. |
| Welding current | 170 A |
| Welding voltage | 25 V |
| Welding speed | 15 cm/min. |
| Heat input | 17 KJ/cm |

(7) Varestraint test (only for B-series steels)

Longi-Varestraint tests were carried out, wherein a welding bead was formed on the test specimen by a TIG welding process and a shock of bending load was applied on a point in the bead length to cause a high temperature crack therein.

The conditions for the tests were as follows.

| | |
|---|---|
| Electrodes used | Th-W electrodes for TIG welding process having 3.2 mm diameter |
| Welding voltage | 18–19 V |
| Welding current | 300 A |
| Welding speeds | 100 mm/min. |
| Argon gas flow rate | 15 l/min. |
| Surface strain | $\epsilon$ = 4% |

3. Test Results (1) Tempering Test and Determination of Standard Tempering Conditions (i) T-series Steels The T series steels were subjected to a tensile test at room temperature after heat treating them at the secondary tempering temperature (T) of 630° C., 660° C., 690° C. or 720° C. as hereinbefore described in 1 (1) (3).

Test results are shown in Table 8. In the case that the tempering temperature is as low as 630–660° C., 0.2% proof stress of T3, T4 and T5 specimens and tensile strength of T4 specimens are almost equal to that of TO, whereas in the case of high tempering temperature exceeding 690° C., tensile strength and 0.2% proof stress of T3, T4 and T5 specimens are much higher than that of TO (TMK2). Tensile strength and 0.2% proof stress of T1 and T2 specimens are higher than that of TO (TMK2) at any tempering temperature. T1 specimen exhibits the maximum 0.2% proof stress. It is apparent from Table 8 that T1–T4 specimens of this invention exhibit excellent resistance to temper softening higher than that of the reference specimen TO due to the action of chromium and cobalt.

(ii) B-series Steel

The above-mentioned normalized specimens according to 1 (2) were heated at 670° C., 700° C., 730° C., 780° C. or 800° C. for 3 hours, and then tempered by air cooling treatment thereby preparing specimens for a room temperature tensile test. The test results are shown in Table 9.

Tensile strength and 0.2% proof stress of the reference specimen BO (NF616) are the lowest among B-series steel specimens at any tempering temperature and the values of the B-series specimens increase in the order of "B1 and B2", "B5" and "B3 and B4". The B1–B4 specimens exhibit excellent resistance to temper softening due to the action of chromium and cobalt, as compared with that of the reference specimen BO. Table 9 shows the action of rhenium as well.

In view of the test results in Tables 8 and 9, a standard tempering treatment for the various test specimens was determined as follows.

Standard tempering treatment for T-series steels:

keeping at 680° C. for 20 hours and air cooling

Standard tempering treatment for B-series steels:

keeping at 770° C. for 1 hour and air cooling (2) Evaluation of the Standard Tempered Specimen The standard tempered specimens of T-series and B-series steels were subjected to following various tests.

(i) Tensile Test at Room Temperature

The test results of room temperature tensile tests are shown in Table 10. The T-series steels of this invention exhibited tensile strength higher than that of the reference specimen TO, and likewise the B-series steels of this invention exhibited tensile strength higher than that of the reference specimen BO. Elongation to rupture of the T-series and B-series steels were about 20%, and they are strong enough.

(ii) Tensile Test at Elevated Temperature

The test results of high temperature tensile tests are shown in Table 4. The tensile strength and 0.2% proof stress of each specimen at 600° C. have a similar tendency to that at room temperature. Both T-series steels and B-series steels exhibited higher tensile strength than that of the reference test specimens TO and BO, respectively, as well as elongation to rupture and reduction of area to rupture.

By adding cobalt to the steel, the amount of chromium, which is effective to improve corrosion resistance, can be increased, and further improvement of the tensile strength of the steel can be obtained. Rhenium has a complementary effect on the action of molybdenum and tungsten, and seems to increase toughness of the resultant steel as hereinafter described. By addition of both cobalt and rhenium, the resultant steel can be excellent in corrosion resistance, as well as tensile strength and toughness, as compared with the reference specimen.

(iii) Charpy Impact Test

Table 12 shows a ductile-brittle transition temperature (FATT) of the T-series steels. As described hereinafter, as the high temperature creep strength increases, the FATT is elevated. However, the extended range of FATT does not cause any problems in the actual use of the T-series steels.

Table 13 shows energy absorption of B-series steel specimens at 0° C., all of which exceed 10 kgf·m. These values are high enough to meet the requirements of the boiler material.

(iv) Visual Inspection of Microstructure

All test specimens of T-series and B-series steels exhibited a tempered martensitic structure. The δ -ferrite phase was scarcely found in the specimens.

(v) Results of Creep Rupture Test

Results of creep rupture tests for T-series and B-series steels carried out at 650° C. are shown in Tables 14 and 15, respectively. It is apparent from the Tables that both T-series and B-series steels of this invention are excellent in creep rupture properties as compared with the reference specimens (TO, BO). Particularly, T-series steel of this invention exhibited excellent creep rupture properties among other conventional turbine steels hitherto developed in and outside Japan.

Seven different creep rupture tests with different conditions were applied to each steel specimen, and, on the basis of the test results, the creep rupture strengths of the steel specimens which were kept at several temperature levels for 100,000 hours were obtained by an interpolating method using the Larson-Miller parameter. The specimen test temperature levels were 580° C., 600° C., 625° C. and 650° C. for T-series steel specimens and 600° C., and 625° C. for B-series steel specimens. The test results are shown in Table 16 and Table 17, wherein the creep rupture strength of both the T-series and B-series steel specimens of this invention are distinctively higher than that of the reference specimens (TO1, BO1).

(vi) Measuring Maximum Hardness of HAZ

In order to investigate susceptibility to low temperature crack formation of B-series steel upon welding, the maximum hardness of HAZ was measured. The test results are shown in Table 18, wherein all the test specimens exhibited 410–420 Hv maximum hardness, by which the B-series steel specimens are presumed to have such susceptibility to low temperature cracking comparable with that of the ordinary 12 Cr steel.

(vii) Results of Varestraint Test

Figure 9:
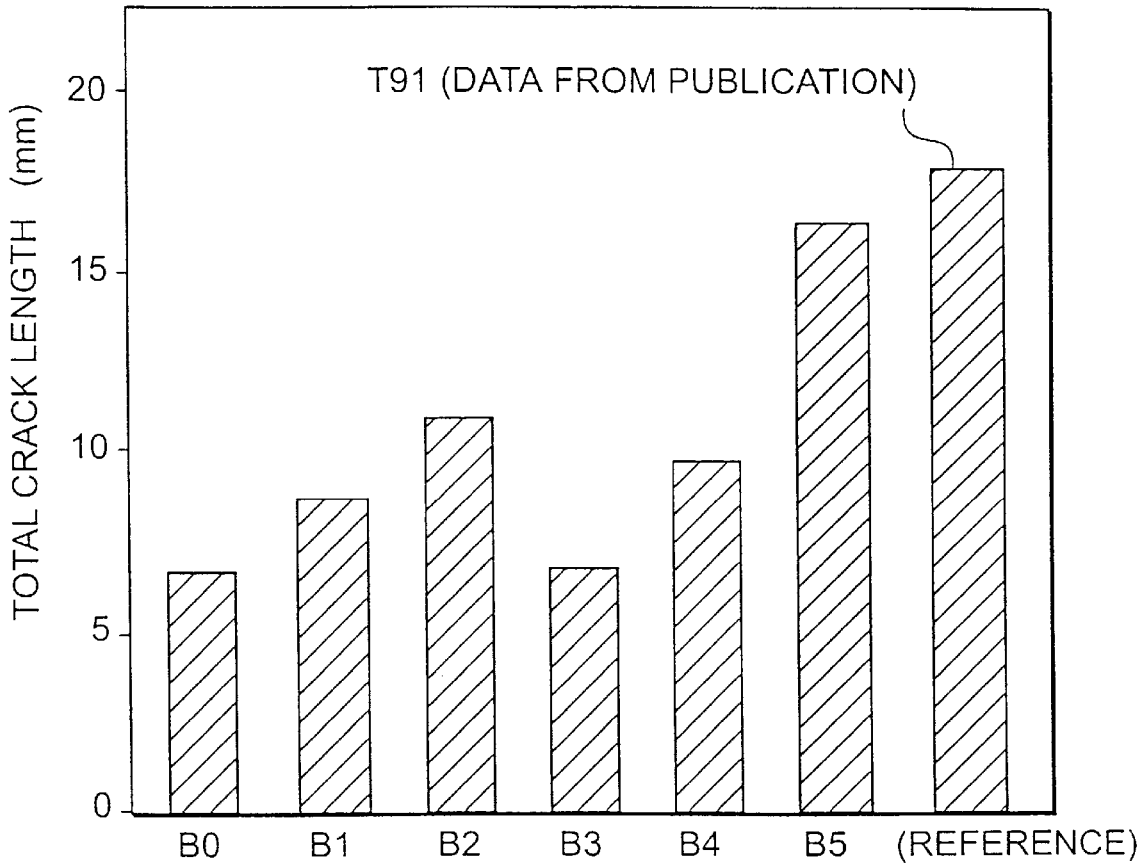
FIG. 9 is a diagram showing results of Varestraint test for B-series specimens of the Example.

In order to investigate susceptibility to high temperature crack formation of the B-series steels upon welding, the above-mentioned Longi-varestraint test was executed. Total tracking lengths are shown in FIG. 9. Although the total cracking lengths of the steel specimens of this invention are equal to or slightly longer than that of the reference specimen (BO), they are shorter than that of T91 steel as a comparative specimen. The B series steel specimens are therefore presumed to have such susceptibility to high temperature cracking comparable with that of the ordinary 12% Cr steel. In view of test results of those items (vi) and (vii), the B-series steels of this invention are said to be a favorable boiler material which must have excellent weldability.

INDUSTRIAL APPLICABILITY

According to the method of this invention, a ferritic iron-base alloy can be designed on the basis of a predicting system without depending upon a series of experimentations which require huge amounts of time, cost and labor, and in particular a ferritic heat resistant steel having excellent physical and chemical properties can be readily and efficiently manufactured. More particularly, the ferritic heat resistant steel having physical and chemical properties more excellent than that of the conventional best quality steels, as disclosed in the Examples, can be theoretically designed and actually manufactured. The ferritic heat resistant steel of this invention also exhibits high corrosion and oxidation resistance, in view of its chemical composition wherein chromium is the main component. The steel of this invention is therefore widely used in heat resistant materials and corrosion resistant materials, and more particularly in members of thermal power plant or the like energy plants which are exposed to severe water vapor attacks. Highly efficient ultra super high critical pressure power plants have been developed in recent years for matching the global environmental safeguard, and the heat resistant steel of this invention is provided with such physical and chemical properties that it is suitable for the members of such power plants.

TABLE 1

Chemical Composition of 9–12% Cr Steels for Boilers (mass %, Fe: bal.)

| Steels | C | Si | Mn | Cr | Mo | W | V | Nb | B | Others |
|---|---|---|---|---|---|---|---|---|---|---|
| 9% Cr Steels | | | | | | | | | | |
| T9 | 0.12 | 0.6 | 0.45 | 9.0 | 1.0 | — | — | — | — | — |
| HCM9M | 0.07 | 0.3 | 0.45 | 9.0 | 2.0 | — | — | — | — | — |
| Tempaloy F-9 | 0.06 | 0.5 | 0.60 | 9.0 | 1.0 | — | 0.25 | 0.40 | 0.005 | — |
| EM12 | 0.10 | 0.4 | 0.10 | 9.0 | 2.0 | — | 0.30 | 0.40 | — | — |
| T91 | 0.10 | 0.4 | 0.45 | 9.0 | 1.0 | — | 0.20 | 0.08 | — | 0.04N |
| NF616 | 0.07 | 0.06 | 0.45 | 9.0 | 0.5 | 1.8 | 0.20 | 0.05 | 0.004 | 0.06N |
| 12% Cr Steels | | | | | | | | | | |
| HCM12 | 0.10 | 0.3 | 0.55 | 12.0 | 1.0 | 1.0 | 0.25 | 0.05 | — | 0.03N |
| AMAX12Cr | 0.07 | 0.3 | 0.60 | 12.0 | 1.5 | 1.0 | 0.20 | 0.05 | — | — |
| HT9 | 0.20 | 0.3 | 0.55 | 12.0 | 1.0 | — | 0.25 | — | — | — |
| HCM12A | 0.11 | 0.1 | 0.60 | 11.0 | 0.4 | 2.0 | 0.20 | 0.05 | 0.003 | 0.06N, 1.0 Cu |
| TB12 | 0.11 | 0.6 | 0.50 | 12.0 | 0.5 | 1.8 | 0.20 | 0.05 | 0.004 | 0.06N |

TABLE 2

Chemical Composition of 9–12% Cr Steels for Turbines (mass %, Fe: bal.)

| Steels | C | Si | Mn | Ni | Cr | Mo | W | V | Nb | B | N |
|---|---|---|---|---|---|---|---|---|---|---|---|
| H46 | 0.15 | 0.40 | 0.60 | — | 12.0 | 0.5 | — | 0.30 | 0.25 | — | 0.050 |
| GE | 0.18 | 0.30 | 0.60 | 0.60 | 10.5 | 1.0 | — | 0.20 | 0.06 | — | 0.060 |
| TAF | 0.20 | 0.30 | 0.50 | — | 10.5 | 1.5 | — | 0.20 | 0.15 | 0.03 | 0.015 |
| TMK1 | 0.14 | 0.05 | 0.50 | 0.60 | 10.3 | 1.5 | — | 0.17 | 0.06 | — | 0.040 |
| TMK2 | 0.14 | 0.05 | 0.50 | 0.50 | 10.5 | 0.5 | 1.8 | 0.17 | 0.06 | — | 0.040 |
| MJC12 | 0.10 | 0.70 | 0.70 | 0.50 | 9.5 | 1.0 | — | 0.15 | 0.06 | — | 0.040 |

TABLE 3

| Elements | | Md (eV) | Bo |
|---|---|---|---|
| 3d | Ti | 2.497 | 2.325 |
| | V | 1.610 | 2.268 |
| | Cr | 1.059 | 2.231 |
| | Mn | 0.854 | 1.902 |
| | Fe | 0.825 | 1.761 |
| | Co | 0.755 | 1.668 |
| | Ni | 0.661 | 1.551 |
| | Cu | 0.637 | 1.361 |
| 4d | Zr | 3.074 | 2.511 |
| | Nb | 2.335 | 2.523 |
| | Mo | 1.663 | 2.451 |
| 5d | Hf | 3.159 | 2.577 |
| | Ta | 2.486 | 2.570 |
| | W | 1.836 | 2.512 |
| | Re | 1.294 | 2.094 |
| Others | C | −0.230 | 0 |
| | N | −0.400 | 0 |
| | Si | 1.034 | 0 |

TABLE 4

Chemical Composition of 9–12% Cr Cast Steels for Turbines (mass %, Fe: bal.)

| Steels | C | Si | Mn | Ni | Cr | Mo | V | W | Nb | N |
|---|---|---|---|---|---|---|---|---|---|---|
| T91 MAN/GF | 0.11 | 0.4 | 0.4 | 0.2 | 9.0 | 0.9 | 0.21 | — | 0.08 | 0.05 |
| T91 HH/Okano | 0.12 | 0.36 | 0.51 | 0.07 | 9.0 | 0.9 | 0.22 | — | 0.10 | 0.03 |
| TSB 12 Cr (Kawagoe) | 0.12 | 0.50 | 0.48 | 0.66 | 10.0 | 0.8 | 0.27 | — | 0.06 | 0.05 |
| MIH 12 Cr (Wakamatsu) | 0.12 | — | — | 0.5 | 10.0 | 0.8 | 0.25 | — | 0.06 | 0.05 |
| Hitachi 12 Cr | 0.13 | 0.28 | 0.58 | 0.58 | 10.5 | 1.1 | 0.22 | 0.23 | 0.06 | 0.04 |

TABLE 5

Chemical Composition of Ferritic Heat Resistance Steels of This Invention (mass %, Fe: bal.)

| | C | N | Si | V | Cr | Mn | Co | Nb | Mo | W | B | Re |
|---|---|---|---|---|---|---|---|---|---|---|---|---|
| No. 1 | 0.07 – | 0.01 – | ≦0.10 | 0.12 – | 10.0 – | ≦0.45 | 0.5 – | 0.02 – | 0.02 – | 0.5 – | 0 – | 0 – |
| T-series | 0.14 | 0.10 | | 0.22 | 13.5 | | 4.3 | 0.10 | 0.8 | 2.6 | 0.02 | 3.0 |
| No. 2 | 0.02 – | 0.01 – | ≦0.50 | 0.15 – | 9.0 – | ≦0.45 | 0.5 – | 0.02 – | 0.02 – | 0.5 – | 0 – | 0 – |
| R-series | 0.12 | 0.10 | | 0.25 | 13.5 | | 4.3 | 0.10 | 0.8 | 2.6 | 0.02 | 3.0 |

TABLE 6

Chemical Composition of Ferritic Heat Resistant Steel Specimens (weight % Fe: bal.)

| Steel | No | C | Si | Mo | P | S | Ni | Cr | Mo | V | W | Nb | Co | Re | sol.Al | B | N |
|---|---|---|---|---|---|---|---|---|---|---|---|---|---|---|---|---|---|
| TMK2 | T0 | 0.14 | 0.05 | 0.53 | 0.003 | 0.002 | 0.54 | 10.42 | 0.51 | 0.18 | 1.83 | 0.06 | —* | —* | —** | —*** | 0.042 |
| T | T1 | 0.14 | 0.02 | 0.01 | 0.002 | 0.003 | —* | 12.07 | 0.49 | 0.17 | 1.81 | 0.06 | 3.08 | 0.92 | —** | 0.008 | 0.042 |
| series | T2 | 0.14 | 0.02 | 0.01 | 0.002 | 0.002 | —* | 12.58 | 0.50 | 0.17 | 1.82 | 0.06 | 3.07 | —* | —** | 0.008 | 0.042 |
| | T3 | 0.11 | 0.02 | 0.01 | 0.002 | 0.003 | —* | 11.05 | 0.39 | 0.20 | 1.95 | 0.08 | 3.09 | 0.92 | —** | 0.008 | 0.019 |
| | T4 | 0.11 | 0.02 | 0.01 | 0.003 | 0.002 | —* | 11.56 | 0.41 | 0.20 | 1.91 | 0.08 | 3.09 | —* | —** | 0.008 | 0.018 |
| | T5 | 0.11 | 0.02 | 0.01 | 0.002 | 0.002 | —* | 11.12 | 0.10 | 0.20 | 1.92 | 0.08 | 3.04 | 1.69 | —** | 0.008 | 0.020 |
| NF616 | R0 | 0.066 | 0.08 | 0.45 | 0.002 | 0.003 | —* | 9.00 | 0.51 | 0.19 | 1.89 | 0.050 | —* | —* | 0.008 | 0.003 | 0.049 |
| R | R1 | 0.066 | 0.08 | 0.46 | 0.002 | 0.003 | —* | 10.04 | 0.50 | 0.19 | 1.89 | 0.050 | 1.49 | —* | 0.011 | 0.003 | 0.048 |
| series | R2 | 0.065 | 0.08 | 0.47 | 0.003 | 0.002 | —* | 10.17 | 0.53 | 0.19 | 1.60 | 0.055 | 1.54 | 0.59 | 0.013 | 0.003 | 0.053 |
| | R3 | 0.066 | 0.08 | 0.48 | 0.003 | 0.002 | —* | 11.73 | 0.49 | 0.19 | 1.89 | 0.050 | 2.54 | —* | 0.011 | 0.003 | 0.053 |
| | R4 | 0.063 | 0.08 | 0.48 | 0.004 | 0.002 | —* | 11.60 | 0.52 | 0.19 | 1.59 | 0.054 | 2.55 | 0.59 | 0.013 | 0.003 | 0.057 |
| | R5 | 0.068 | 0.06 | 0.19 | 0.001 | 0.002 | —* | 11.65 | 0.10 | 0.23 | 1.66 | 0.046 | 2.83 | 1.58 | 0.003 | 0.003 | 0.046 |

Note:
—*; less than 0.01,
—**; less than 0.005,
—***; less than 0.0010

TABLE 7

| Steel No. | | Average Md | Average Bo | $Ac_1$ (° C.) | $Ac_3$ (° C.) |
|---|---|---|---|---|---|
| T-Series | TMK2 T0 | 0.8519 | 1.804 | 788 | 886 |
| | T1 | 0.8555 | 1.812 | 817 | 910 |
| | T2 | 0.8554 | 1.813 | 820 | 890 |
| | T3 | 0.8560 | 1.811 | 805 | 863 |
| | T4 | 0.8558 | 1.812 | 815 | 882 |
| | T5 | 0.8559 | 1.811 | 802 | 877 |
| B-Series | NF616 B0 | 0.8526 | 1.803 | 831 | 955 |
| | B1 | 0.8542 | 1.806 | 819 | 947 |
| | B2 | 0.8544 | 1.807 | 823 | 940 |
| | B3 | 0.8574 | 1.814 | 812 | 940 |
| | B4 | 0.8572 | 1.813 | 814 | 937 |
| | B5 | 0.8575 | 1.814 | 799 | 917 |

TABLE 8

Results of Tensile Test (T-series)

| Steel No. | Tempering Temp. (° C.) | 0.2% Proof Stress ($kgf/mm^2$) | Tensile Strength ($kgf/mm^2$) | Rupture Elongation (%) | Reduction of Area (%) |
|---|---|---|---|---|---|
| T0 | 630 | 84.4 | 98.9 | 19 | 56 |
| | 660 | 81.1 | 95.2 | 20 | 56 |
| | 690 | 76.1 | 89.9 | 21 | 61 |
| | 720 | 65.4 | 80.4 | 23 | 64 |
| T1 | 630 | 87.8 | 105.8 | 18 | 45 |
| | 660 | 84.8 | 102.9 | 18 | 47 |
| | 690 | 82.2 | 99.4 | 19 | 49 |
| | 720 | 77.3 | 93.9 | 19 | 52 |
| T2 | 630 | 86.7 | 104.5 | 18 | 45 |
| | 660 | 84.1 | 101.9 | 18 | 48 |
| | 690 | 82.0 | 98.9 | 18 | 48 |
| | 720 | 78.1 | 94.4 | 18 | 46 |
| T3 | 630 | 84.2 | 100.3 | 19 | 57 |
| | 660 | 81.7 | 97.3 | 20 | 58 |
| | 690 | 79.3 | 94.4 | 21 | 60 |

TABLE 8-continued

Results of Tensile Test (T-series)

| Steel No. | Tempering Temp. (° C.) | 0.2% Proof Stress (kgf/mm$^2$) | Tensile Strength (kgf/mm$^2$) | Rupture Elongation (%) | Reduction of Area (%) |
|---|---|---|---|---|---|
| | 720 | 76.4 | 91.2 | 22 | 63 |
| T4 | 630 | 82.5 | 98.1 | 18 | 50 |
| | 660 | 80.7 | 96.2 | 18 | 53 |
| | 690 | 79.2 | 93.8 | 19 | 57 |
| | 720 | 76.7 | 91.0 | 20 | 58 |
| T5 | 630 | 84.0 | 100.1 | 19 | 55 |
| | 660 | 82.1 | 97.6 | 20 | 58 |
| | 690 | 80.2 | 94.9 | 20 | 56 |
| | 720 | 76.2 | 90.7 | 21 | 60 |

TABLE 9

Results of Tensile Test (B-series)

| Steel No. | Tempering Temp. (° C.) | 0.2% Proof Stress (kgf/mm$^2$) | Tensile Strength (kgf/mm$^2$) | Rupture Elongation (%) | Reduction of Area (%) |
|---|---|---|---|---|---|
| B0 | 670 | 82.8 | 94.7 | 19 | 70 |
| | 700 | 79.7 | 91.7 | 21 | 73 |
| | 730 | 70.6 | 82.3 | 20 | 71 |
| | 760 | 54.5 | 69.6 | 23 | 75 |
| | 780 | 49.3 | 66.1 | 26 | 76 |
| | 800 | 46.2 | 63.2 | 27 | 77 |
| B1 | 670 | 83.0 | 95.3 | 19 | 72 |
| | 700 | 80.1 | 92.3 | 21 | 72 |
| | 730 | 75.3 | 87.7 | 21 | 73 |
| | 760 | 61.1 | 74.7 | 23 | 72 |
| | 780 | 52.9 | 68.9 | 25 | 77 |
| | 800 | 47.3 | 64.9 | 28 | 77 |
| B2 | 670 | 84.2 | 96.9 | 19 | 72 |
| | 700 | 81.2 | 93.9 | 20 | 72 |
| | 730 | 75.8 | 88.5 | 20 | 72 |
| | 760 | 63.2 | 76.8 | 22 | 73 |
| | 780 | 55.0 | 70.7 | 25 | 75 |
| | 800 | 48.4 | 66.1 | 27 | 77 |
| B3 | 670 | 82.8 | 96.9 | 20 | 70 |
| | 700 | 80.6 | 94.3 | 19 | 70 |
| | 730 | 77.2 | 91.1 | 21 | 70 |
| | 760 | 68.4 | 82.6 | 21 | 68 |
| | 780 | 59.7 | 75.8 | 22 | 73 |
| | 800 | 52.8 | 69.8 | 25 | 73 |
| B4 | 670 | 84.6 | 99.0 | 10 | 70 |
| | 700 | 82.2 | 96.0 | 20 | 72 |
| | 730 | 77.6 | 92.1 | 21 | 72 |
| | 760 | 70.2 | 84.1 | 20 | 72 |
| | 780 | 60.7 | 76.3 | 23 | 74 |
| | 800 | 54.0 | 71.4 | 25 | 75 |
| B5 | 670 | 86.4 | 100.3 | 20 | 70 |
| | 700 | 83.5 | 97.1 | 20 | 70 |
| | 730 | 78.4 | 91.5 | 21 | 68 |
| | 760 | 62.0 | 82.1 | 20 | 72 |
| | 780 | 57.1 | 74.1 | 23 | 73 |
| | 800 | 52.3 | 70.5 | 27 | 73 |

TABLE 10

Results of Tensile Test at Room Temperature (T.B-series)

| Steel No. | 0.2% Proof Stress (kgf/mm$^2$) | Tensile Strength (kgf/mm$^2$) | Rupture Elongation (%) | Reduction of Area (%) |
|---|---|---|---|---|
| T0 | 77.5 | 91.4 | 21 | 59 |
| T1 | 83.0 | 100.4 | 18 | 47 |
| T2 | 81.5 | 99.2 | 17 | 48 |
| T3 | 78.8 | 94.1 | 21 | 60 |
| T4 | 78.7 | 93.4 | 20 | 57 |

TABLE 10-continued

Results of Tensile Test at Room Temperature (T.B-series)

| Steel No. | 0.2% Proof Stress (kgf/mm$^2$) | Tensile Strength (kgf/mm$^2$) | Rupture Elongation (%) | Reduction of Area (%) |
|---|---|---|---|---|
| T5 | 80.6 | 95.6 | 20 | 58 |
| B0 | 57.8 | 72.1 | 22 | 77 |
| B1 | 62.9 | 77.2 | 22 | 74 |
| B2 | 63.5 | 78.1 | 24 | 74 |
| B3 | 70.2 | 84.0 | 20 | 70 |
| B4 | 72.0 | 86.1 | 19 | 73 |
| B5 | 73.5 | 86.3 | 19 | 70 |

TABLE 11

Results of Tensile Test at 600° C. (T.B-series)

| Steel No. | 0.2% Proof Stress (kgf/mm$^2$) | Tensile Strength (kgf/mm$^2$) | Rupture Elongation (%) | Reduction of Area (%) |
|---|---|---|---|---|
| T0 | 45.0 | 53.0 | 26 | 87 |
| T1 | 53.3 | 61.1 | 17 | 66 |
| T2 | 51.5 | 59.9 | 16 | 63 |
| T3 | 52.7 | 58.6 | 20 | 81 |
| T4 | 49.7 | 58.4 | 20 | 80 |
| T5 | 51.1 | 59.2 | 19 | 79 |
| B0 | 32.7 | 39.8 | 25 | 85 |
| B1 | 34.8 | 42.8 | 27 | 85 |
| B2 | 35.0 | 42.9 | 33 | 85 |
| B3 | 37.8 | 46.2 | 29 | 85 |
| B4 | 38.5 | 46.9 | 26 | 84 |
| B5 | 41.1 | 48.8 | 22 | 83 |

TABLE 12

Results of Impact Test (T-series)

| Steel No. | Ductile-Brittle Transition Temperature (FATT) |
|---|---|
| T0 | 14–34° C. |
| T1 | 50–60° C. |
| T2 | 53–59° C. |
| T3 | 79–90° C. |
| T4 | 88–98° C. |
| T5 | 88–99° C. |

TABLE 13

Results of Impact Test (B-series)

| Steel No. | Absorbed Energy at 0° C. |
|---|---|
| B0 | 17.5 kgf · m |
| B1 | 17.8 kgf · m |
| B2 | 17.1 kgf · m |
| B3 | 10.4 kgf · m |
| B4 | 11.8 kgf · m |
| B5 | 11.0 kgf · m |

TABLE 14

Results of Creep Rupture Test (T-series)

| Steel No. | Testing Temp. (° C.) | Testing Stress (kgf/mm$^2$) | Testing Time (hr) | Rupture Elongation (%) | Reduction of Area (%) |
|---|---|---|---|---|---|
| T0 | 650 | 24.5 | 23.5 | 23 | 86 |
| T1 | 650 | 24.5 | 305.3 | 19 | 60 |
| T2 | 650 | 24.5 | 192.2 | 23 | 72 |
| T3 | 650 | 24.5 | 459.4 | 16 | 68 |
| T4 | 650 | 24.5 | 284.5 | 22 | 79 |
| T5 | 650 | 24.5 | 578.3 | 18 | 58 |

TABLE 15

Results of Creep Rupture Test (T-series)

| Steel No. | Testing Temp. (° C.) | Testing Stress (kgf/mm$^2$) | Testing Time (hr) | Rupture Elongation (%) | Reduction of Area (%) |
|---|---|---|---|---|---|
| B0 | 650 | 15.5 | 250.0 | 25 | 77 |
| B1 | 650 | 15.5 | 1233.1 | 20 | 73 |
| B2 | 650 | 15.5 | 1343.6 | 19 | 72 |
| B3 | 650 | 15.5 | 1205.6 | 22 | 79 |
| B4 | 650 | 15.5 | 1594.7 | 22 | 78 |
| B5 | 650 | 15.5 | (2277.3)* | | |

Note: *; under testing

TABLE 16

Creep Rupture Strength (T-series)

| | $10^5$ hr Creep Rupture Strength (kgf/mm$^2$) | | | |
|---|---|---|---|---|
| Steel No. | 580° C. | 600° C. | 625° C. | 650° C. |
| T0 | 21.8 | 17.2 | 12.3 | 8.4 |
| T1 | 28.9 | 23.9 | 17.8 | 11.7 |
| T2 | 28.1 | 22.8 | 17.0 | 10.6 |
| T3 | 29.8 | 25.0 | 19.1 | 13.1 |
| T4 | 28.5 | 23.8 | 18.5 | 12.9 |
| T5 | 30.1 | 25.5 | 20.0 | 14.7 |

TABLE 17

Creep Rupture Strength (B-series)

| | $10^5$ hr Creep Rupture Strength (kgf/mm$^2$) | |
|---|---|---|
| Steel No. | 600° C. | 625° C. |
| B0 | 14.9 | 11.3 |
| B1 | 17.2 | 13.3 |
| B2 | 17.5 | 13.4 |
| B3 | 18.4 | 14.2 |
| B4 | 18.6 | 14.4 |
| B5 | 21.9 | 15.1 |

TABLE 18

Results of Maximum Hardness Measurement on Heat Affected Zone (Hv 10)

| Steel No. | Maximum Hardness of HAZ (A) | Hardness of Parent Metal (B) | ΔHv (A − B) |
|---|---|---|---|
| B0 | 402 | 227 | 175 |
| B1 | 411 | 252 | 159 |

TABLE 18-continued

Results of Maximum Hardness Measurement on Heat Affected Zone (Hv 10)

| Steel No. | Maximum Hardness of HAZ (A) | Hardness of Parent Metal (B) | ΔHv (A − B) |
|---|---|---|---|
| B2 | 417 | 260 | 157 |
| B3 | 417 | 273 | 144 |
| B4 | 422 | 274 | 148 |
| B5 | 405 | 277 | 128 |

What is claimed is:

1. A ferritic heat resistant steel substantially free of delta-ferrite and consisting essentially of, in weight %, 0.07–0.14% carbon, 0.01–0.10% nitrogen, not more than 0.10% silicon, 0.12–0.22% vanadium, 10.0–13.5% chromium, not more than 0.45% manganese, more than 1.5 to 4.3% cobalt, 0.02–0.10% niobium, 0.02–0.8% molybdenum, less than 2.0% tungsten, 0.001–0.02% boron, 0–3.0% rhenium, not more than 0.40% nickel and the balance iron and incidental impurities, the ferritic heat resistant steel having a body centered cubic crystal structure and containing alloying elements wherein (1) d-electron orbital energy levels (Md) of the alloying elements and bond orders (Bo) of the alloying elements relative to iron (Fe) are determined by a Dv-Xα cluster method and (2) individual alloying elements and amounts thereof are such that an average Bo value is expressed by {average Bo value=ΣXi·[−](Bo)i} and an average Md value is expressed by {average Md value=ΣXi·(Md)i} wherein Xi is atomic fraction of an alloying element i, and (Bo)i and(Md)i are Bo value and Md value for the alloying element i, respectively, the average Bo value being in a range of 1.805 to 1.817, and the average Md value being in a range of 0.8520 to 0.8628, wherein the Md values are 2.497 for Ti, 1.610 for V, 1.059 for Cr, 0.854 for Mn, 0.825 for Fe, 0.755 for Co, 0.661 for Ni, 0.637 for Cu, 3.074 for Zr, 2.335 for Nb, 1.663 for Mo, 3.159 for Hf, 2.486 for Ta, 1.836 for W, 1.294 for Re, −0.230 for C, −0.400 for N and 1.034 for Si and the Bo values are 2.325 for Ti, 2.268 for V, 2.231 for Cr, 1.902 for Mn, 1.761 for Fe, 1.668 for Co, 1.551 for Ni, 1.361 for Cu, 2.511 for Zr, 2.523 for Nb, 2.451 for Mo, 2.577 for Hf, 2.570 for Ta, 2.512 for W, 2.094 for Re, 0 for C, 0 for N and 0 for Si.

2. A ferritic heat resistant steel according to claim 1, wherein boron is present in an amount of at least 0.003%.

3. A ferritic heat resistant steel according to claim 1, wherein 0.5≦W<2.0%.

4. A ferritic heat resistant steel substantially free of delta-ferrite and consisting essentially of, in weight %, 0.02–0.14% carbon, 0.01–0.10% nitrogen, not more than 0.50% silicon, 0.12–0.25% vanadium, 9.0–13.5% chromium, not more than 0.45% manganese, more than 1.5 to 4.3% cobalt, 0.02–0.10% niobium, 0.02–0.8% molybdenum, less than 2.0% tungsten, 0.001–0.02% boron, 0–3.0% rhenium, not more than 0.40% nickel and the balance iron and incidental impurities, the ferritic heat resistant steel having a body centered cubic crystal structure and containing alloying elements wherein (1) d-electron orbital energy levels (Md) of the alloying elements and bond orders (Bo) of the alloying elements relative to iron (Fe) are determined by a Dv-Xα cluster method and (2) individual alloying elements and amounts thereof are such that an average Bo value is expressed by {average Bo value=ΣXi·[−](Bo)i} and an average Md value is expressed by {average Md value=ΣXi·(Md)i} wherein Xi is atomic fraction of an alloying element i, and (Bo)i and (Md)i are Bo value and Md value for the alloying element i, respectively, the average Bo value being in a range of 1.805 to 1.817, and the average Md value being in a range of 0.8520 to 0.8628, wherein the Md values are 2.497 for Ti, 1.610 for V, 1.059 for Cr, 0.854 for Mn, 0.825 for Fe, 0.755 for Co, 0.661 for Ni, 0.637 for Cu, 3.074 for Zr, 2.335 for Nb, 1.663 for Mo, 3.159 for Hf, 2.486 for Ta, 1.836 for W, 1.294 for Re, −0.230 for C, −0.400 for N and 1.034 for Si and the Bo values are 2.325 for Ti, 2.268 for V, 2.231 for Cr, 1.902 for Mn, 1.761 for Fe, 1.668 for Co, 1.551 for Ni, 1.361 for Cu, 2.511 for Zr, 2.523 for Nb, 2.451 for Mo, 2.577 for Hf, 2.570 for Ta, 2.512 for W, 2.094 for Re, 0 for C, 0 for N and 0 for Si.

5. A ferritic heat resistant steel according to claim 4, wherein boron is present in an amount of at least 0.003%.

6. A ferritic heat resistant steel according to claim 4, wherein $0.5 \leqq W < 2.0\%$.

7. A ferritic heat resistant steel according to claim 1, wherein the steel comprises a structural member of a turbine.

8. A ferritic heat resistant steel according to claim 4, wherein the steel comprises a structural member of a boiler.

* * * * *